United States Patent [19]

Fassett et al.

[11] 4,176,359

[45] Nov. 27, 1979

[54] MONOPULSE ANTENNA SYSTEM WITH INDEPENDENTLY SPECIFIABLE PATTERNS

[75] Inventors: Matthew Fassett, Billerica; Seymour B. Pizette, Framingham; John F. Toth, Billerica, all of Mass.

[73] Assignee: Raytheon Company, Lexington, Mass.

[21] Appl. No.: 816,421

[22] Filed: Jul. 18, 1977

[51] Int. Cl.[2] ..... H01Q 3/26

[52] U.S. Cl. ..... 343/854; 343/16 M

[58] Field of Search ..... 343/853, 854, 16 M, 343/100 SA

[56] References Cited

U.S. PATENT DOCUMENTS

| | | | |
|---|---|---|---|
| 3,392,395 | 7/1968 | Hannan | 343/777 |
| 3,868,695 | 2/1975 | Kadak | 343/854 |
| 3,940,770 | 2/1976 | Fassett et al. | 343/854 |
| 4,028,710 | 6/1977 | Evans | 343/854 |

*Primary Examiner*—Eli Lieberman

*Attorney, Agent, or Firm*—Richard M. Sharkansky; Joseph D. Pannone

[57] ABSTRACT

A radio frequency antenna adapted to provide independently specifiable sum, azimuth, and elevation antenna patterns is disclosed. The antenna includes a plurality of rows of antenna elements each having a corresponding feed network. Each feed network has three row feed ports and couples energy between such feed ports and the corresponding row of antenna elements with independent amplitude and phase distributions. A second feed network couples energy between sum, azimuth, and elevation ports of the antenna and the three row feed ports of the feed networks with independent amplitudes and phase distribution to provide independent sum, azimuth, and elevation antenna patterns.

4 Claims, 3 Drawing Figures

MONOPULSE ANTENNA SYSTEM WITH INDEPENDENTLY SPECIFIABLE PATTERNS

BACKGROUND OF THE INVENTION

This invention relates generally to radio frequency antennas and more particularly to feed networks for use in multi-element monopulse antenna systems.

As is known in the art, a monopulse antenna, in its most basic configuration, includes a cluster of four horns, or antenna elements, disposed in four quadrants of an array, such elements being coupled to a monopulse arithmetic unit to provide sum, azimuth and elevation antenna patterns. In many applications, however, additional antenna elements are required in order to improve the sidelobe characteristics of either relatively small array monopulse antennas or monopulse antennas using a multielement feed for a radio frequency lens or reflector. One such multi-element monopulse antenna is discussed in an article entitled "A Multi-element High Power Monopulse Feed With Low Sidelobes and High Aperture Efficiency," by H. S. Wong, R. Tang and E. E. Barber, published in IEEE Transactions on Antenna and Propagation, Vol. AP-22, No. 3, May 1974. In such multi-element monopulse antenna independent control of the sum, azimuth and elevation antenna patterns is provided by grouping the antenna elements in sets of four, forming sum and difference outputs for each set using four hybrids and combining such outputs with power dividers to form a sum output azimuth output and elevation output.

SUMMARY OF THE INVENTION

With this background of the invention in mind, it is therefore an object of this invention to provide an improved multi-element monopulse antenna.

This and other objects of the invention are attained generally by providing a monopulse antenna adapted to provide independently specifiable sum, azimuth and elevation antenna patterns, such antenna comprising: A plurality of rows of antenna elements; a plurality of feed networks, each one of such feed networks being coupled to a corresponding one of the rows of antenna elements, such feed networks having three row feed ports and means for coupling energy between such row feed ports and the antenna elements coupled thereto with independent amplitude and phase distributions; sum, azimuth and elevation ports, such ports being associated with the sum, azimuth and elevation antenna patterns, respectively; and means for coupling energy between the sum, azimuth and elevation ports and the three row feed ports of the plurality of feed networks with independent amplitude and phase distributions to provide independent sum, azimuth and elevation antenna patterns.

In a preferred embodiment of the invention, the rows of antenna elements are disposed symmetrically about an elevation axis and the columns of antenna elements are disposed symmetrically about an azimuth axis. In each one of the rows of antenna elements, pairs for symmetrically disposed antenna elements are coupled to the arms of a corresponding one of a plurality of couplers. "In-phase" and "out-of-phase" ports of such couplers are coupled to corresponding feed structures. One of the pair of feed structures is coupled to a first and a second one of the three row feed ports and the other one of the feed structures is coupled to a third one of the row feed ports. The sum port is coupled to the first one of the row feed ports of each of the feed networks, the azimuth port is coupled to the third one of the row feed ports of each of the feed networks, and the elevation port is coupled to the first and the second ones of the row feed ports of each of the feed networks.

BRIEF DESCRIPTION OF THE DRAWINGS

The foregoing features of this invention, as well as the invention itself, may be more fully understood from the following detailed description read together with the accompanying drawing.

DESCRIPTION OF THE PREFERRED EMBODIMENT

Figure 1:
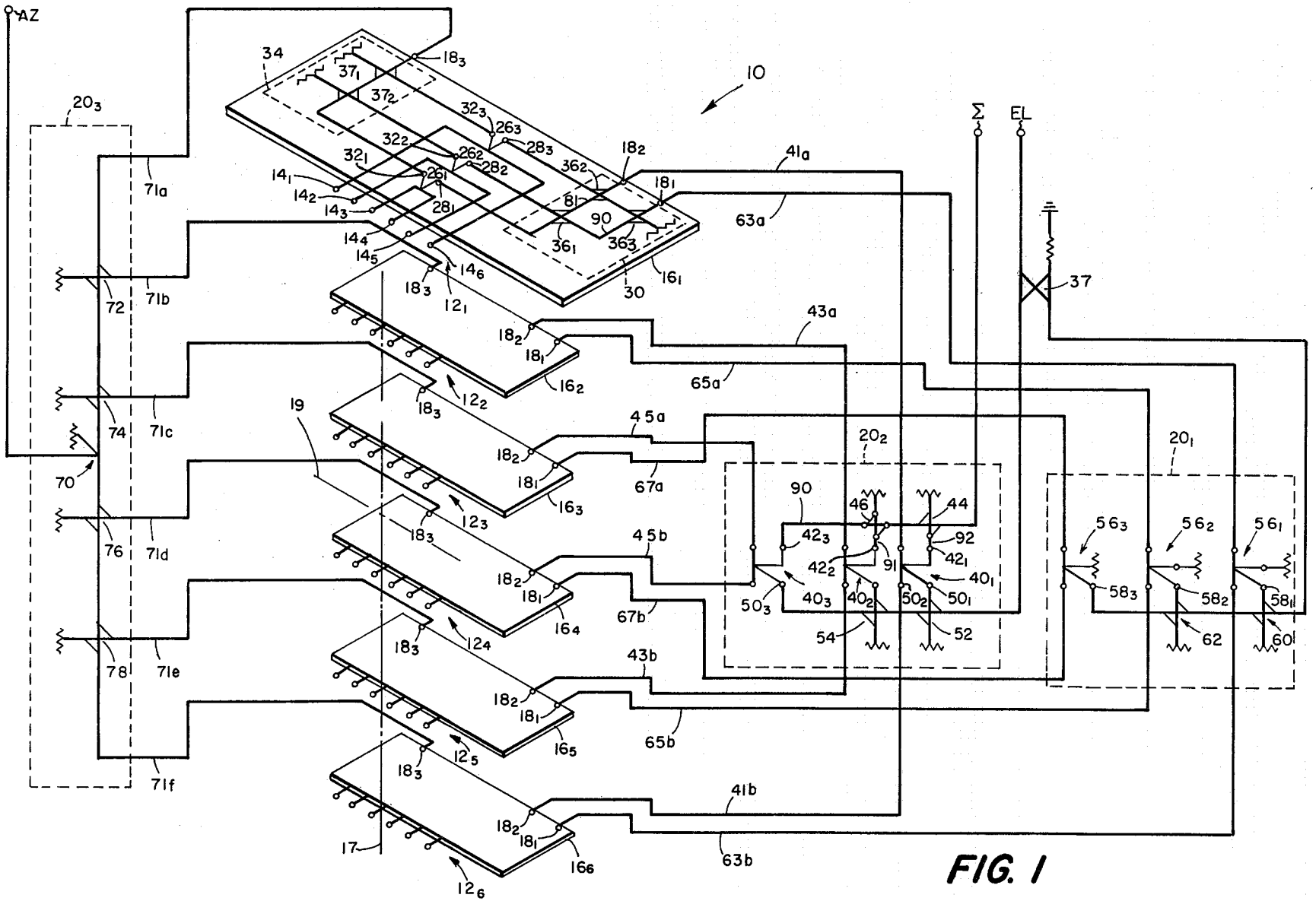
FIG. 1 is a schematic diagram of a radio frequency antenna according to the invention.

Referring now to FIG. 1, a monopulse antenna 10 adapted to provide independently specifiable sum, azimuth and elevation antenna patterns is shown. It is noted that such antenna 10 may be used as a multi-element feed for a radio frequency lens or reflector. Such antenna 10 includes an array of antenna elements, here arranged in a rectangular matrix of rows and columns. More particularly, antenna 10 includes a plurality of, here six, rows $\mathbf{12_1}$–$\mathbf{12_6}$ of antenna elements, each row here including six antenna elements $\mathbf{14_1}$–$\mathbf{14_6}$, thereby forming a six-by-six rectangular matrix of antenna elements. The antenna elements in each one of the rows $\mathbf{12_1}$–$\mathbf{12_6}$ are disposed symmetrically about an azimuth axis 17, and the antenna elements in each column are disposed symmetrically about an elevation axis 19, as indicated.

Each one of a plurality of, here six, feed networks $\mathbf{16_1}$–$\mathbf{16_6}$ has three row feed ports $\mathbf{18_1}$, $\mathbf{18_2}$, $\mathbf{18_3}$ and couples energy betwen such row feed ports $\mathbf{18_1}$, $\mathbf{18_2}$, $\mathbf{18_3}$ and the antenna elements $\mathbf{14_1}$–$\mathbf{14_6}$ coupled thereto with three independent amplitude and phase distributions. Sum (Σ), azimuth (AZ) and elevation (EL) ports, associated with the sum, azimuth and elevation antenna patterns, respectively, are provided. Feed networks $\mathbf{20_1}$, $\mathbf{20_2}$, $\mathbf{20_3}$ couple energy between the sum (Σ), azimuth (AZ) and elevation (EL) ports and the three row feed ports $\mathbf{18_1}$, $\mathbf{18_2}$, $\mathbf{18_3}$ of each of the feed networks $\mathbf{16_1}$–$\mathbf{16_3}$ with three independent amplitude and phase distributions to provide the independent sum, azimuth and elevation antenna pattern.

Referring now to an exemplary one of the feed networks, say feed network $\mathbf{16_1}$, such feed network $\mathbf{16_1}$ is shown to include a plurality of, here three, couplers, here hybrid junctions $\mathbf{26_1}$–$\mathbf{26_3}$, each one having a pair of arms coupled to a corresponding pair of antenna elements which are disposed symmetrically about the azimuth axis 17. In particular, antenna elements $\mathbf{14_1}$ and $\mathbf{14_6}$ are coupled to the arms of hybrid junction $\mathbf{26_3}$ by transmission lines (not numbered) each having the same electrical length; antenna elements $\mathbf{14_2}$ and $\mathbf{14_5}$ are coupled to the arms of hybrid junction $\mathbf{26_2}$ by transmission lines (not numbered) here each having the same electrical length; and antenna elements $\mathbf{14_3}$ and $\mathbf{14_4}$ are coupled to hybrid junction $\mathbf{26_1}$ with transmission lines (not numbered) having equal electrical lengths. The sum or "in phase" ports $\mathbf{28_1}$, $\mathbf{28_2}$, $\mathbf{28_3}$ of hybrid junctions $\mathbf{26_1}$, $\mathbf{26_2}$, $26_3$, respectively, are coupled to row feed ports $18_1$, $18_2$ through an end-fed ladder feed network 30 and the difference or "out-of-phase" ports $32_1$, $32_2$, $32_3$, of hybrid junctions $26_1$, $26_2$, $26_3$, respectively, are coupled to row feed ports $18_3$ through an end-fed series feed network 34, as indicated. It is noted that each one of the row feed networks $16_1$–$16_6$ here includes a pair of stripline circuits (not shown), one having formed thereon hybrid junctions $26_1$–$26_3$ and transmission lines coupling end portions to networks 30, 34, and the other having formed thereon the networks 30, 34, such pair of circuits being electrically connected with suitable feedthroughs (not shown). (It is further noted, therefore, that energy passing between the antenna elements $14_1$–$14_6$ and "in phase" ports $28_1$, $28_2$, $28_3$ will have even symmetry about the azimuth axis 17, and energy passing between the antenna elements $14_1$–$14_6$ and the "out-of-phase" ports $32_1$, $32_2$, $32_3$ will have odd symmetry about the azimuth axis 17). The details of feed network 30 will be described in connection with FIGS. 2 and 3. Suffice it to say here, however, that the feed network 30 is adapted to provide: a first predetermined amplitude and phase distribution to energy coupled between row feed ports $18_2$ and antenna elements $14_1$–$14_6$, such distribution being in accordance with the coupling factors of directional couplers $36_1$, $36_2$, the electrical lengths of transmission lines 80, 82, 84 (numbered only in FIG. 2) which couple the "in phase" ports $28_1$, $28_2$, $28_3$ to such fed network 30, and the electrical length of the transmission line 81 (numbered only in FIG. 2) which couples directional coupler $36_2$ to directional coupler $36_1$; and a second, independent predetermined amplitude and phase distribution to energy passing through such feed network 30 between both row feed ports $18_1$ and $18_2$ and the antenna elements $14_1$–$14_6$, such distribution being in accordance with the coupling factors of directional couplers $36_1$, $36_2$, $36_3$, the electrical lengths of transmission lines 80, 81, 82, 84, 86 and 90 (numbered only in FIG. 2) and the relative amplitude and phase of the energy appearing at both row feed port $18_1$ and row feed port $18_2$. As will be discussed further hereinafter, the row feed port $18_2$ is coupled to the sum output port via feed network $20_2$, the energy appearing at such row feed port $18_2$ being in accordance with the first distribution and therefore the first distribution is associated with the sum antenna pattern; whereas both row feed ports $18_1$ and $18_2$ are coupled to the elevation (EL) output port because of a directional coupler 37. The relative amplitude and phase of the energy appearing at both row feed ports $18_1$, $18_2$ is associated with the second distribution, as will be discussed; the second distribution is associated with the elevation antenna pattern. It is also noted that both the first and second distributions (i.e., those distributions established, inter alia, by the feed network 30) will each have even symmetry about the azimuth axis 17, because such network 30 is coupled to the "in phase" ports $28_1$, $28_2$, $28_3$ of hybrid coupler $26_1$, $26_2$, $26_3$, respectively. Therefore, the elevation antenna pattern and the sum antenna pattern will have even symmetry about the azimuth axis 17.

A third, independent predetermined amplitude and phase distribution is provided to energy passing between row feed port $18_3$ and antenna elements $14_1$–$14_6$, such distribution being in accordance with the coupling factors of directional couplers $37_1$, $37_2$ and the electrical length of transmission lines (not numbered) used in such network 34. The row feed port $18_3$ is coupled to the azimuth (AZ) port via a feed network $20_3$, the energy appearing at row feed port $18_3$ being in accordance with the third distribution and, as will be discussed, the third distribution is associated with the azimuth antenna pattern. Further, the third distribution will have odd symmetry about the azimuth axis 17 because feed network 34 is coupled to the "out-of-phase" ports $32_1$, $32_2$, $32_3$ of hybrid couplers $26_1$, $26_2$, $26_3$, respectively.

Feed network $20_2$ includes a plurality of, here three, hybrid junctions $40_1$, $40_2$, $40_3$, the arms of which are coupled to row feed port $18_2$ of: feed networks $16_1$, $16_6$; feed networks $16_2$, $16_5$; and feed networks $16_3$, $16_4$, respectively, as shown in FIG. 1. The "in phase" ports $42_1$, $42_2$, $42_3$ of hybrid junctions $40_1$, $40_2$, $40_3$, respectively, are coupled to the sum (Σ) output port through directional couplers 44, 46, as shown. The electrical lengths of transmission lines 41*a*, 41*b*, which couple hybrid junction $40_1$ to both networks $16_1$ and $16_6$, are equal to each other; the electrical lengths of the transmission lines 43*a*, 43*b*, which couple hybrid junction $40_2$ to both networks $16_2$ and $16_5$ are equal to each other; and the electrical lengths of the transmission lines 45*a*, 45*b*, which couple hybrid junction $40_3$ to both networks $16_3$ $16_4$, which are equal to each other. Therefore, the energy coupled between the sum (Σ) output port and the antenna elements in each one of the six columns thereof will have even symmetry about the elevation axis 19. The amplitude distribution down one of the columns of antenna elements (i.e., antenna elements $14_1$ of rows $12_1$–$12_6$, or antenna elements $14_2$ of rows $12_1$–$12_6$, etc.) is in accordance with the coupling factors of directional couplers 44, 46 and the phase distribution down any one of the columns of antenna elements is here in accordance with the electrical lengths of transmission lines 41*a*, 41*b*, 43*a*, 43*b*, 45*a*, 45*b* and the electrical lengths of transmission lines 90, 91, 92 in feed network $20_2$. It follows then that energy is coupled between the entire array of antenna elements and the sum (Σ) port with independent amplitude and phase distributions across each row of elements (such distributions being in accordance with the first distribution established by the coupling of factors and electrical lengths of the directional couplers and transmission lines, respectively, used in the feed networks $16_1$–$16_6$ coupled to such row of antenna elements) and independent amplitude and phase distribution down each one of the columns of antenna elements (such amplitude distribution being in accordance with the coupling factors of directional couplers 44, 46 and such phase distribution being in accordance with the electrical lengths of the transmission lines 41*a*, 41*b*, 43*a*, 43*b*, 45*a*, 45*b*, 90, 91, 92). These "row" and "column" distributions provide the sum antenna pattern.

The elevation (EL) output port is coupled to the "out-of-phase" ports $50_1$, $50_2$, $50_3$ of hybride junctions $40_1$, $40_2$ and $40_3$, respectively, through the directional coupler 37 and the directional couplers 52, 54 of feed network $20_2$, as indicated in FIG. 1; and to the "out-of-phase" ports $58_1$, $58_2$, $58_3$ of of hybrid junctions $56_1$, $56_2$, $56_3$, respectively, through the directional coupler 37 and the directional couplers 60, 62 of feed network $20_1$, as indicated. The arms of hybrid junctions $56_1$, $56_2$, $56_3$ are coupled to: row feed port $18_1$ of feed networks $16_1$, $16_6$ via transmission lines 63*a*, 63*b*, respectively; and feed port $18_1$ of feed networks $16_2$, $16_5$ via transmission lines 65*a*, 65*b*, respectively; and feed port $18_1$ of feed networks $16_3$, $16_4$ via transmission lines 67*a*, 67*b*, respectively, as indicated. Further, the electrical lengths of transmission lines 63*a*, 63*b* are equal to each other and the electrical lengths of transmission lines 65*a*, 65*b* are equal to each other, and the electrical lengths of transmission lines 67*a*, 67*b* are equal to each other. It follows, then, that, because energy is coupled between the "out-of-phase" ports of hybrid junctions $58_1$, $58_2$, $58_3$, energy coupled between the elevation (EL) output port and each one of the columns of antenna elements in the array will have odd symmetry about the elevation axis 19. Further, as discussed above, the second amplitude and phase distributions are established for each row of antenna elements in accordance with the relative amplitude and phase of the energy appearing at the row feed ports $18_1$, $18_2$, of the feed network coupled to such row of antenna elements. Thus, relative amplitude and phase of the energy appearing at row feed ports $18_1$, $18_2$ is achieved by coupling the elevation (EL) output port in both row feed ports $18_1$, $18_2$, through both networks $20_1$, $20_2$, via the dirctional coupler 37. That is proper relative amplitude and phase of energy appearing at row feed ports $18_1$ and $18_2$ is controlled by selection of the coupling factors of directional couplers 37, 60, 62, 52 and 54 (for relative amplitude of the energy appearing at row feed ports $18_1$, $18_2$ for each of the feed networks: $16_1$, $16_6$; $16_2$, $16_5$; $16_3$, $16_4$) and the electrical lengths of transmission lines 41*a*, 41*b*, 43*a*, 43*b*, 45*a*, 45*b*, 63*a*, 63*b*, 65*a*, 65*b*, 67*a*, 67*b*, 90, 91, and 92 (for relative phase of the energy appearing at row feed ports $18_1$, $18_2$ for each of the feed networks: $16_1$, $16_6$; $16_2$, $16_5$; $16_3$, $16_4$). It follows then that energy is coupled between the elevation (EL) port and the entire array of antenna elements, each symmetrically disposed column of antenna elements in the array having an independent amplitude and phase distribution. Further, the amplitude and phase distribution of energy down any column which is associated with the sum (Σ) port is independent from the amplitude and phase distribution of energy down the same column which is associated with the elevation (EL) output port. Therefore, the antenna 10 is adapted to provide independent sum and elevation antenna patterns.

Considering now the azimuth (AZ) output port, such port is coupled to the "in phase" port of hybrid junction 70. The arms of hybrid junction 70 are coupled to the row feed port $18_3$ of the feed networks $16_1$–$16_6$ via directional couplers 72, 74, 76, 78 and transmission lines 71*a*–71*f*, as indicated. Considering row feed port $18_3$ of feed network $16_1$, energy is coupled between the antenna elements $14_1$–$14_6$ in row $12_1$ and such row feed port $18_3$ through hybrid junctions $26_1$–$26_3$ and series feed network 34. In particular, such energy is coupled between such row feed port $18_3$ and the "out-of-phase" ports $32_1$, $32_2$, $32_3$ of hybrid junctions $26_1$, $26_2$, $26_3$, respectively, through directional couplers $37_1$, $37_2$, as indicated. Further, the electrical length of transmission lines 71*a* and 71*f* are equal to each other, the electrical lengths of transmission lines 71*b* and 71*e* are equal to each other, and the electrical lengths of transmission lines 71*c* and 71*d* are equal to each other. It is first noted, therefore, that the distribution of energy passing between such row feed ports $18_3$ and the antenna elements $14_1$–$14_6$ has odd symmetry about the azimuth axis 17 and independent amplitude and phase distribution at such "out-of-phase" ports in accordance with the coupling factors of directional couplers $37_1$, $37_2$ and the electrical lengths of the transmission lines coupling such feed network 34 to the "out-of-phase" ports $32_1$, $32_2$, $32_3$ of hybrid junctions $26_1$, $26_2$, $26_3$, respectively. It follows then that this amplitude and phase distribution of energy coupled between the antenna elements $14_1$–$14_6$ of row $12_1$ and the azimuth (AZ) output port is independent from the amplitude and phase distribution of energy coupled between such antenna elements and the sum (Σ) output port. Further, independent amplitude and phase distribution between each row of antenna elements is provided in accordance with the coupling factors of directional couplers 72, 74, 76 and 78 and the electrical lengths of the transmission lines 71*a*–71*f* coupled between such directional couplers 72, 74, 76, 78 and the feed networks $16_1$–$16_6$.

Figure 2:
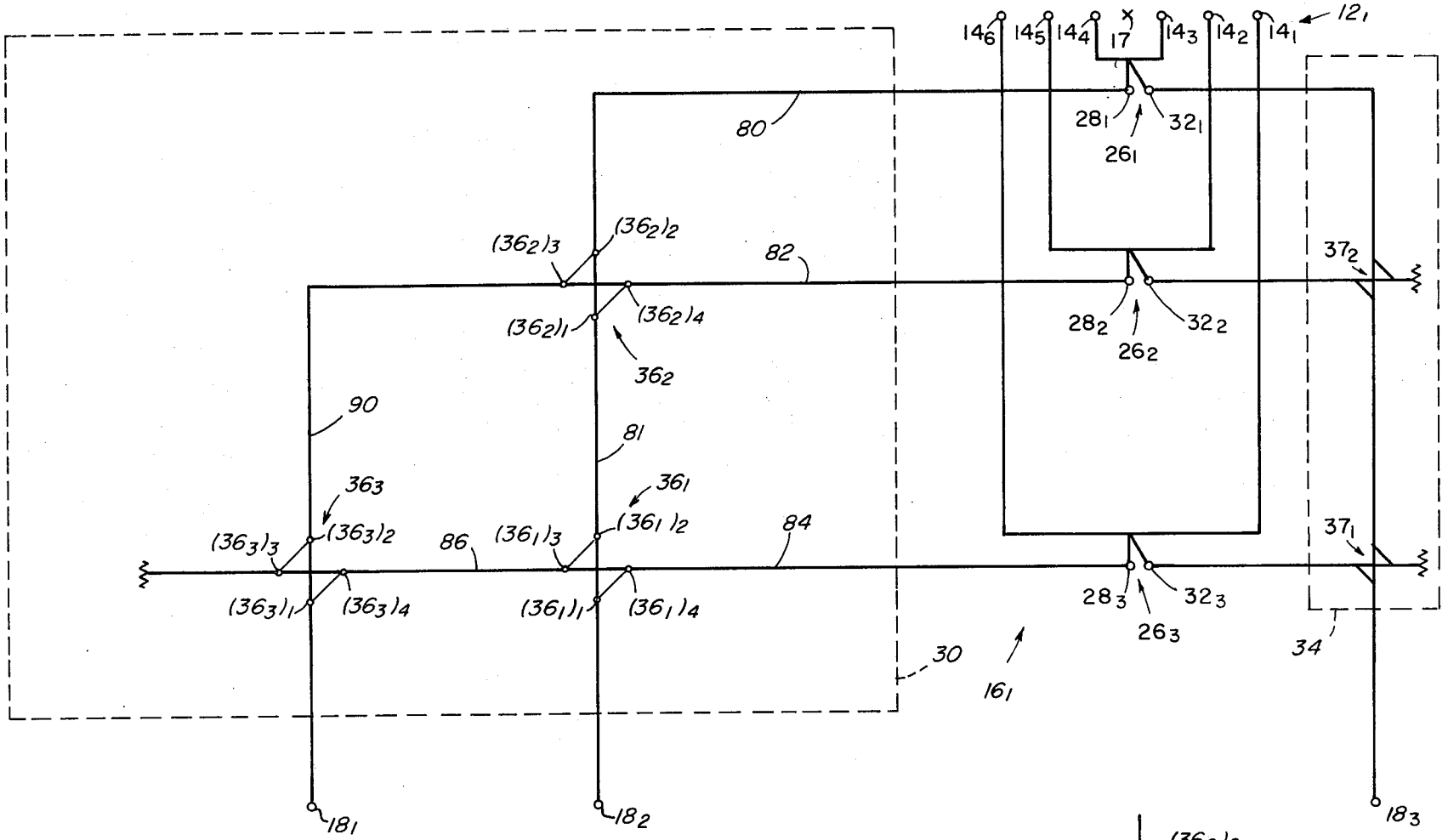
FIG. 2 is a schematic diagram of a row feed network used in the antenna of FIG. 1 coupled to a row of antenna elements of such antenna.
Figure 3:
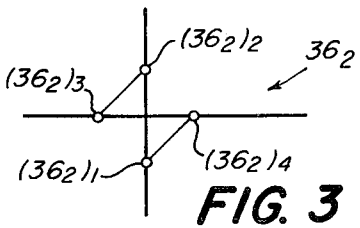
FIG. 3 is a schematic diagram of a coupler used in the feed network of FIG. 2.

Referring now to FIG. 2, feed network 30 is shown in detail to include directional couplers $36_1$, $36_2$, $36_3$ arranged as shown. An exemplary one of the directional couplers $36_1$–$36_3$, here directional coupler $36_2$, is shown in FIG. 2 to have a pair of ouput ports $(36_2)_2$, $(36_2)_4$, a pair of input ports $(36_2)_1$, $(36_2)_3$ and a coupling factor $K36_2$. The relationship between input voltages, output voltages and coupling factor of such coupler $36_2$ may be related, for matched conditions, according to the following equations:

$$V(36_2)_2 = -j\sqrt{1-K36_2^2}\,V(36_2)_1 + K36_2\,V(36_2)_3 \quad (1)$$

$$V(36_2)_4 = K36_2 L\,V(36_2)_1 - J\sqrt{1-K36_2^2}\,V(36_2)_3 \quad (2)$$

where:

$V(36_2)_1$ is the incident wave, or inprint voltage at input port $(36_2)_1$;

$V(36_2)_3$ is the incident wave, or input voltage at input port $(36_2)_3$;

$V(36_2)_2$ is the reflected wave, or output voltage at output port $(36_2)_2$;

$V(36_2)_4$ is the reflected wave or output voltage at output port $(36_2)_4$; and $j=\sqrt{-1}$.

As discussed in connection with FIG. 1, the feed network 30 (FIG. 2) is adapted to provide two independent amplitude and phase distributions: a first distribution being associated with energy coupled between row feed port $18_2$ and "in phase" ports $28_1$, $28_2$, $28_3$ of hybrid junctions $26_1$, $26_2$, $26_3$, respectively, such distribution being in accordance with the coupling factors $K36_2$, $K36_1$ of directional couplers $36_2$, $36_1$, respectively, and the electrical lengths of transmission lines 80, 81, 82 and 84; and a second, independent distribution associated with the energy coupled between both row feed ports $18_1$, $18_2$ and the "in phase" ports $28_1$, $28_2$, $28_3$ of hybrid junctions $26_1$, $26_2$, $26_3$, respectively, such distribution being in accordance with the coupling factors $K36_1$, $K36_2$, $K36_3$ of directional couplers $36_1$, $36_2$, $36_3$, the electrical lengths of transmission lines 80, 81, 82, 84, 86, 90 and the relative amplitude and phase of the energy appearing at both row feed ports $18_1$, $18_2$.

For example, if it is desired that the first distribution have voltages $A_1 \angle -a_1$; $A_2 \angle -a_2$; and $A_3 \angle -a_3$ at "in phase" ports $28_1$, $28_2$, $28_3$, respectively, in response to a voltage $V_{182}(1)$ at row feed port $18_2$, the electrical lengths of transmission lines 80, 82 84 are selected to provide phase delays of $a_1-90°$; $a_2$; and $a_3$, respectively, for energy passing between ports $(36_2)_2$, $(36_2)_4$ and $(36_1)_4$ and ports $28_1$, $28_2$, $28_3$, respectively. The coupling factors $K36_2$, $K36_1$ and the electrical length of transmission line 81 are selected to produce voltage $A_1 \angle -90°$; $A_2 \angle 0°$; and $A_3 \angle 0°$ at ports $(36_2)_2$; $(36_2)_4$; and $(36_1)_4$, respectively.

To obtain such voltages, considering first directional coupler $36_2$, it is noted that, because we are considering the first distribution (i.e., the energy appearing solely at feed port $18_2$) the energy at feed port $18_1$ is here assumed zero and, hence, $V(36_2)_3=0$. Therefore, from equations (1) and (2):

$$V(36_2)_2=-j\sqrt{1-K36_2^2}\,V(36_2)_1 \tag{3}$$

and $$V(36_2)_4=K36_2V(36_2)_1 \tag{4}$$

Therefore, from equations (3) and (4):

$$|V(36_2)_2|^2/|V(36_2)_4|^2=(1-K36_2^2)/(K36_2^2) \tag{5}$$

or, from equation (5):

$$K36_2^2=\frac{|V(36_2)_4|^2}{|V(36_2)_2|^2+|V(36_2)_4|^2} \tag{6}$$

and, therefore:

$$K36_2=\frac{|A_2|^2}{|A_1|^2+|A_2|^2} \tag{7}$$

likewise, for directional coupler $36_1$, to establish the coupling factor $K36_1$, here again assuming $V(36_2)_3=0$, $$K36_1^2=\frac{|A_3|^2}{|A_1|^2+|A_2|^2+|A_3|^2} \tag{8}$$

In order to obtain proper phase angles for the voltages at ports $(36_2)_2$, $(36_2)_4$ and $(36_1)_4$, the electrical lengths of transmission line 81 is here selected to produce a 270° phase shift to energy passing through such line. Therefore, the coupling factors of directional couplers $36_1$, $36_2$ and the electrical lengths of transmission lines 80, 82, 84 and 81 are established by the requirements in obtaining the first distribution.

Considering now the second amplitude and phase distribution, say a voltage distribution at ports $28_1$, $28_2$, $28_3$ of $B_1\angle b_1$, $B_2,\angle b_2$, and $B_3\angle b_3$, respectively, it is first noted that the coupling factors $K36_1$, $K36_2$ and the electrical lengths of transmission lines 80, 81, 82 and 84 have been established to obtain the first distribution as discussed above. Therefore, because of the lengths of transmission lines 80, 82, 84, it is necessary that the voltages: $B_1\angle B1+(A_1-90°)$; $B_2\angle b_2+a_2$; and $B_3\angle b_3+a_3$are required at ports $(36_2)_2$; and $(36_2)_4$and $(36_1)_4$, respectively, in order to provide the second distribution. Rewriting equations (1) and (2) in terms of input voltages, $V(36_2)_1$ and $V(36_2)_3$:

$$V(36_2)_1=K36_2V(36_2)_4+jV(36_2)_2 29\ 1-K36_2^2 \tag{9}$$

$$V(36_2)_3=K36_2V(36_2)_2+jV(36_2)_4\sqrt{1-K36_2^2} \tag{10}$$

It is noted that, to produce the required voltages associated with the second distribution at ports $(36_2)_2$ and $(36_2)_4$, from equations (9) and (10):

$$V(36_2)_1=K36_2B_2\angle b_2+a_2+jB_1\sqrt{1-K36_2^2}\angle b_1-+(a_1-90°) \tag{11}$$

$$V(36_2)_3=K36_2\,B_1\,\underline{/\,b_1+(a_1+90°)}\;+ \tag{12}$$

-continued $$jB_2\sqrt{1-K36_2^2}\,\underline{/\,b_2+a_2}$$

Considering first the voltage $V(36_2)_1$, to produce such voltage, the voltage at port $(36_1)_2$ must be (considering a phase delay of here 270°) from transmission line 81:

$$\begin{aligned}V(36_1)_2 &= V(36_2)_1\,\underline{/\,+270°} \\ &= K36_2\,B_2\,\underline{/\,b_2+a_2+270°}\;+ \\ &\quad jB_1\sqrt{1-K36_2^2}\,\underline{/\,b_1+(a_1+180°)}\end{aligned} \tag{13}$$

To produce such voltage, $V(36_1)_2$, the following voltages must appear at ports $(36_1)_3$ and $(36_1)_1$, respectively:

$$V(36_1)_1=K36_1V(36_1)_4+jV(36_1)_2\sqrt{1-K36_1^2} \tag{14}$$

$$V(36_1)_3=K36_1V(36_1)_2+jV(36_1)_4\sqrt{1-K36_1^2} \tag{15}$$

It is first noted that:

$$V(36_1)_4=B_3\angle b_3+a_3$$

$$V(36_1)_2=K36_2B_2\angle b_2+a_2+270°+j-B_1\sqrt{1-K36_2^2}\angle b_1+(a_1+180°)$$

and $K36_2$ and $K36_1$ are established by the requirements of the first distribution; therefore, the voltages $V(36_1)_1$ and $V(36_1)_3$ may be determined in terms of known parameters. Further, here the electrical length of the transmission line connecting port $(36_1)_1$ and row feed port $18_2$ is one wavelength and, therefore, the voltage at row feed port $18_2$ (i.e., $V18_2^{(2)}$) for the second distribution is equal to the voltage at port $(36_1)_1$ (i.e., $V(36_1)_1$). That is, in summary to this point, to establish the second distribution:

$$\begin{aligned}V18_2^{(2)} = V(36_1)_1 &= K36_1[B_3\,\underline{/\,b_3+a_3}\,] \\ &\quad + j\sqrt{1-K36_1^2}\;K36_2\{B_2\,\underline{/\,b_2+a_2+270°} \\ &\quad + jB_1\sqrt{1-K36_2^2}\,\underline{/\,b_1+(a_1+180°)}\,\} \\ &= |V18_2^{(2)}|\,\underline{/\,\theta 18_2}\end{aligned} \tag{16}$$

$$\begin{aligned}V(36_2)_3 &= K36_2\,B_1\,\underline{/\,b_1+(a_1-90°)} \\ &\quad + jB_2\sqrt{1-K36_2^2}\,\underline{/\,b_2+a_2} \\ &= |V(36_2)_3|\,\underline{/\,\theta(36_2)_3}\end{aligned} \tag{17}$$

$$\begin{aligned}V(36_1)_3 &= K36_1[K36_2B_2\,\underline{/\,b_2+a_2+270°} \\ &\quad + jB_1\sqrt{1-K36_2^2}\,\underline{/\,b_1+a_1+180°}\,] \\ &\quad + j\sqrt{1-K36_1^2}\;B_3\,\underline{/\,a_3+b_3} \\ &= |V(36_1)_3|\,\underline{/\,\theta(36_1)_3}\end{aligned} \tag{18}$$

Therefore, it is evident that, in order to obtain the second distribution, the calculated voltages must appear at row feed ports $18_2$ and at ports $(36_2)_3$ and $(36_1)_3$. To obtain the calculated voltages at ports $(36_2)_3$ and $(36_1)_3$, it is noted that a proper must appear at row feed port $18_1$, and therefore the second distribution is obtained by controlling, in addition to the coupling factors $K36_1$, $K36_2$, $K36_3$ and the lengths of transmission lines 80, 81, 82, 84, 86, 90, the relative amplitude and phase of the voltage at row feed ports $18_1$ and $18_2$.

Continuing then, to produce the proper voltages at ports $(36_2)_3$ and $(36_1)_3$ (as set forth in equations (17) and (18)), it is first noted that because transmission line 90 (i.e., the line between ports $(36_3)_2$ and $(36_2)_3$) is assumed substantially lossless:

$$|V(36_3)_2|^2 = |V(36_2)_3|^2 \tag{19}$$

and because transmission line 86 (i.e., the line between ports $(36_3)_4$ and $(36_1)_3$) is assumed lossless:

$$|V(36_3)_4|^2 = |V(36_1)_3|^2 \tag{20}$$

For a matched network, the voltage at feed port $(36_3)_3$ is established as zero (during transmit) and therefore:

$$K36_3^2 = \frac{|V(36_3)_4|^2}{|V(36_3)_4|^2 + |V(36_3)_2|^2} \tag{21}$$

for reasons analogous to those discussed in connection with equations (4), (5) and (6). Therefore, because $V(36_2)_4 = V(36_3)_2$, K36 may be calculated from equations (17), (18), (19) and (21). Also because the electrical length of transmission line 86 is one wavelength:

$$V(36_3)_2 = -j\sqrt{1-K36_3^2}\, V(36_3)_1 = -j\sqrt{1-K36_3^2}\, V18_1 \tag{22}$$

and $$V(36_1)_3 = V(36_3)_4 = K36_3 V(36_3)_1 = K36_3 V18_1 \tag{23}$$

from equations equivalent to equations (1) and (2). Therefore, from equations (22) and (23), it is noted that $V(36_3)_2$ is delayed by 90° relative to $V(36_3)_4$. Therefore, the electrical length of transmission line 90 is selected so that the phase of the voltage at port $(36_2)_3$ is $\theta(36_2)_3$. That is, $\theta(36_2)_3$ plus the phase shift provided by the transmission line 90, $\theta$, is equal to the phase of the voltage at port $(36_3)_4$ (i.e., $\theta(36_3)_4$) minus 90°. That is, since:

$$V(36_2)_3 \triangleq |V(36_2)_3| \angle\theta(36_2)_3 \tag{24}$$

and $$V(36_3)_4 \triangleq |V(36_3)_4| \angle\theta(36_3)_4 \tag{25}$$

if the phase shift provided by transmission line 90 is $\theta$ then:

$$\theta(36_2)_3 + \theta = \theta(36_3)_4 - 90° \tag{26}$$

or $$\theta = \theta(36_3)_4 - 90° - \theta(36_2)_3 \tag{27}$$

That is, the phase delay provided by transmission line 90 and the coupling factor $K36_3$ of directional coupler $36_3$ enable the required voltage to be established at ports $(36_2)_3$ and $(36_1)_3$ in response to a voltage $V18_1^{(2)}$ at port $18_1$ (where the electrical length of the transmission line between row feed port $18_1$ and port $(36_3)_1$ is one wavelength). That is, $V18_1^{(2)} = V(36_1)_3/K36_3$ and, from equation (18)

$$V18_1^{(2)} = (K36_1[K36_2 B_2 \angle b_2 + a_2 + 270° \tag{28}$$

-continued $$+ jB_1\sqrt{1-K36_2^2}\,\angle b_1 + a_1 + 180°\,]$$

$$+ j\sqrt{1-K36_1^2}\,(B_3)\,\angle b_3 + a_3\,)\,(1/K36_3)$$

$$= (1/K36_3)|V(36_1)_3|\,\angle\theta(36_1)_3$$

and $$V18_2^{(2)} = |V18_2^{(2)}| \angle\theta 18_2 \tag{29}$$

In summary, then, the second distribution is obtained by establishing at row feed ports $18_1$, $18_2$ the voltages $V18_1^{(2)}$, $V18_2^{(2)}$, respectively as set forth in equations (28), (29), respectively.

As noted above, both ports $18_1$ and $18_2$ are coupled to the elevation (EL) port (FIG. 1) via feed networks $20_1$, $20_2$ and directional coupler 37 and row feed port $18_2$ is coupled to the sum (Σ) port via feed network $20_2$. The requisite voltages $V18_1^{(2)}$, $V18_2^{(1)}$, $V18_2^{(2)}$ are established by such networks $20_1$, $20_2$ and the electrical lengths of transmission lines used to make up such networks and to interconnect the feed networks $16_1$–$16_2$ and elevation (EL) port and sum (Σ) port.

In like manner, voltages necessary to produce first and second distributions to row feed ports $18_1$, $18_2$ of the remaining feed networks $16_2$–$16_6$ are calculated. To calculate the coupling factor of coupler 37, i.e., K37, the following equation is used:

$$K37^2 = (P18_1)/(P18_1 + P18_2) \tag{30}$$

where $P18_1$ is the portion of the total power required at the row feedports $18_1$ (i.e., supplied to each of the networks $16_1$–$16_6$ to establish the second distribution $$P18_1 = \sum_{n=16_1}^{16_6} |V(18_1^{(2)})_n|^2$$

where n designates the row feed networks $16_1$–$16_6$).

$P18_2$ is the portion of the total power required at the row feed ports $18_2$ supplied to each of the networks $16_1$–$16_6$ to establish the second distribution $$P18_2 = \sum_{n=16_1}^{16_6} |V(18_2^{(2)})_n|^2.$$

Considering now feed network $20_1$, the directional couplers 60, 62 and the electrical lengths of lines *63a, 63b, 65a, 65a, 65b, 67a, 67b* are selected to produce the calculated distribution to energy associated with the second distribution at row feed ports $18_1$ of the networks $16_1$–$16_6$. That is, if the voltages at feed ports $18_1$ for networks $16_1$–$16_6$ to produce such second distribution are: $C_1\angle c_1$, $C_2\angle c_2$, $C_3\angle c_3$, $C_3\angle c_3 + 180°$, $C_2\angle c_2 + 180°$, $C_1\angle c_1 + 180°$ (noting the "odd" symmetry), respectively, the coupling factor of coupler 62, $K_{62}$ is:

$$K_{62}^2 = \frac{|C_2|^2}{|C_3|^2 + |C_2|^2}$$

and the coupling factor of directional coupler 60, $K_{60}$, is:

$$K60^2 = \frac{|C_1|^2}{|C_1|^2 + |C_2|^2 + |C_3|^2}$$

for reasons similar to those discussed above, and the electrical lengths of transmission lines 63*a*, 65*a*, 67*a* (and hence 63*b*, 65*b*, 67*b*) are selected to produce the requisite phase angles $c_1$, $c_2$, $c_3$. Likewise, considering feed network $\mathbf{20}_1$, the directional couplers 52, 54 and the electrical lengths of transmission lines 41*a*, 41*b*, 43*a*, 43*b*, 45*a*, 45*b* are selected to produce the calculated voltages associated with the second distribution at ports $\mathbf{18}_2$ (i.e., $V\mathbf{18}_2^{(2)}$) for feed networks $\mathbf{16}_1$–$\mathbf{16}_6$. That is, if voltages at row feed ports $\mathbf{18}_2$ (i.e., $V\mathbf{18}_2^{(2)}$) for networks $\mathbf{16}_1$–$\mathbf{16}_6$ are: $D_1\angle d_1$, $D_2\angle d_2$, $D_3\angle d_3$, $D_3\angle d_3+180°$, $D_2\angle d_2+180°$, $D_1\angle d_1+180°$, respectively (note the "odd" symmetry), the coupling factor of directional coupler 54, K54, is:

$$K54^2 = \frac{|D_1|^2}{|D_3|^2 + |D_2|^2}$$

and the coupling factor of directional coupler 52, K52, is:

$$K52^2 = \frac{|D_1|^2}{|D_1|^2 + |D_2|^2 + |D_3|^2}$$

and the electrical lengths of transmission lines 41*a*, 43*a*, 45*a* (and hence 41*b*, 43*b*, 45*b*) are selected to produce proper phase angles: $d_1$, $d_2$, $d_3$.

The couplers 46, 44 and the electrical lengths of transmission lines 90, 91, 92 (the transmission lines coupling port $\mathbf{42}_3$ to coupler 46, the line coupling port $\mathbf{42}_2$ to coupler 46 and the line coupling port $\mathbf{42}_1$ to coupler 44, respectively) are selected to provide the proper phase angles to the voltages at row feed ports $\mathbf{18}_2$ to establish the first distribution, i.e., the voltages $V\mathbf{18}_2^{(1)}$. That is, if the voltages $V\mathbf{18}_2^{(1)}$ at ports $\mathbf{18}_2$ for the feed networks $\mathbf{16}_1$–$\mathbf{16}_6$ for the first distribution are: $E_1\angle e_1$, $E_2\angle e_2$, $E_3\angle e_3$, $E_3\angle e_3$, $E_2\angle e_2$, $E_1\angle e_1$, respectively (note the "even" symmetry), the coupling factor of directional coupler 46, K46, is:

$$K46^2 = \frac{|E_2|^2}{|E_3|^2 + |E_2|^2}$$

the coupling factor for directional coupler 44, K44, is:

$$K44^2 = \frac{|E_1|^2}{|E_1|^2 + |E_2|^2 + |E_3|^2}$$

and the electrical lengths of transmission lines 90, 91, 92 are selected to produce the proper phase angles $e_1$, $e_2$, $e_3$.

Considering now the azimuth, or third distribution, it is noted that a predetermined distribution down the column of row feed ports $\mathbf{18}_3$ is obtained from the couplers 72–78 and lengths of lines 71*a*–71*f*, and the distribution across each row of elements is obtained from the network 34 in each of the feed networks $\mathbf{16}_1$–$\mathbf{16}_6$.

From the above, these independently specified sum, azimuth and elevation antenna patterns are established, such patterns being associated with the sum (Σ), azimuth (AZ) and elevation (EL) ports, respectively.

It should be noted that, while certain transmission line lengths were stated to be one wavelength for purposes of simplicity in understanding the invention, such lengths are selected to provide the required phase shifts at the nominal design frequency and are further selected to minimize output variations over the operating band.

Having described a preferred embodiment of this invention, variations and modifications will now become readily apparent to those of skill in the art. For example, the sum port (Σ) may be coupled to row feed ports $\mathbf{18}_1$, $\mathbf{18}_2$ and the elevation port (EL) coupled to only port $\mathbf{18}_2$. It is felt, therefore, that the invention should not be limited to such embodiment but rather should be limited only by the spirit and scope of the appended claims.

What is claimed is:

1. A monopulse antenna adapted to provide independently specifiable sum, azimuth and elevation antenna patterns, such antenna comprising:

(a) a plurality of rows of antenna elements;

(b) a plurality of feed networks, each one thereof coupled to a corresponding one of the rows of antenna elements and having: First, second and third feed ports; and means for coupling energy between the feed ports and the antenna elements coupled thereto with three independent amplitude and phase distributions, each one of such feed networks comprising:

(i) a first coupling network coupled to the first and second feed ports and having a plurality of output ports;

(ii) a second coupling network coupled to the third feed port and having a plurality of output ports; and (iii) a plurality of couplers, each one having an "in phase" port, an "out of phase" port and a pair of output ports, the "in phase" ports of the plurality of couplers being connected to the plurality of output ports of the first coupling network, the "out of phase" ports of the plurality of couplers being connected to the plurality of output ports of the second coupling network, a first one of the pair of output ports of the couplers being coupled to a first portion of the antenna elements in the row coupled thereto and a second one of the pair of output ports of the couplers being coupled to a second portion of the antenna elements in the row coupled thereto, the first and second portions of antenna elements being disposed symmetrically about an azimuth axis; and (c) means for coupling energy between the first, second and third feed ports of the plurality of feed networks and sum, azimuth and elevation antenna ports with independent amplitude and phase distributions to provide the independent sum, azimuth and elevation antenna patterns.

2. The antenna recited in claim 1 wherein the energy coupling means comprises:

(a) a third coupling network having an input port coupled to the azimuth antenna port and having a plurality of output ports coupled to the third feed ports of the plurality of feed networks;

(b) a fourth coupling network having a first and second input port and a plurality of output ports, such first input port being connected to the sum antenna port, the second input port being connected to the azimuth antenna port, and the plurality of output ports being coupled to the first feed ports of the plurality of feed networks; and (c) a fifth coupling network having an input port coupled to the elevation antenna port and a plurality of output ports coupled to the second feed ports of the plurality of feed networks.

3. A monopulse antenna adapted to provide independently specifiable sum, azimuth and elevation antenna patterns, such antenna comprising: (a) a plurality of rows of antenna elements;

(b) a plurality of feed networks, each one thereof coupled to a corresponding one of the rows of antenna elements, each one of such feed networks having:

(i) a plurality of couplers having independently specifiable coupling factors;

(ii) a plurality of phase shift means interconnected with the plurality of couplers;

(iii) three feed ports interconnected with the plurality of couplers and the plurality of phase shift means;

(iv) a plurality of output ports coupled to the antenna elements in the row coupled thereto; and (v) wherein the phase shifts provided by the plurality of phase shift means and the coupling factors are selected to couple energy between the three feed ports and the antenna elements coupled thereto with three independent amplitude and phase distributions;

(c) sum, azimuth and elevation ports, such ports being associated with the sum, azimuth and elevation antenna patterns, respectively; and (d) means for coupling energy between the sum, azimuth and elevation ports and the three feed ports of the plurality of feed networks with independent amplitude and phase distribution to provide the independent sum azimuth and elevation antenna patterns.

4. The antenna recited in claim 3 wherein the energy coupling means includes a plurality of couplers having independently specifiable coupling factors and a plurality of interconnected phase shift means.

* * * * *